US007748530B2

(12) United States Patent
Hsu et al.

(10) Patent No.: US 7,748,530 B2
(45) **Date of Patent: *Jul. 6, 2010**

(54) WELDING WIRE PACKAGE

(75) Inventors: Christopher Hsu, Mentor, OH (US); David J. Barton, Twinsburg, OH (US); Michael A. Carroscia, Newbury, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 133 days.

This patent is subject to a terminal disclaimer.

(21) Appl. No.: 12/069,788

(22) Filed: Feb. 13, 2008

(65) Prior Publication Data

US 2008/0210585 A1 Sep. 4, 2008

Related U.S. Application Data

(63) Continuation of application No. 10/988,892, filed on Nov. 15, 2004, now Pat. No. 7,377,388.

(51) Int. Cl.
*B65D 85/04* (2006.01)

(52) U.S. Cl. ..... 206/408; 206/397; 206/389

(58) Field of Classification Search ..... 206/408, 206/397, 389, 407; 242/579, 590, 588.3, 242/129, 566, 593, 588.6
See application file for complete search history.

(56) References Cited

U.S. PATENT DOCUMENTS

| | | | |
|---|---|---|---|
| 1,640,368 | A | 8/1927 | Obetz et al. |
| 2,713,938 | A | 7/1955 | Snyder |
| 2,724,538 | A | 11/1955 | Schweich |
| 2,869,719 | A | 1/1959 | Hubbard |
| 2,929,496 | A | 3/1960 | Muehlebach et al. |
| 2,974,850 | A | 3/1961 | Mayer |
| 3,244,347 | A | 4/1966 | Jenk |
| 3,491,876 | A | 1/1970 | Zecchin |
| 3,843,071 | A | 10/1974 | Graham |
| 4,582,198 | A | 4/1986 | Ditton |
| 4,623,063 | A | 11/1986 | Balkin |
| 4,869,367 | A | 9/1989 | Kawasaki et al. |
| 4,903,833 | A | 2/1990 | Beery |
| 5,078,269 | A | 1/1992 | Dekko et al. |
| 5,109,983 | A | 5/1992 | Malone et al. |

(Continued)

FOREIGN PATENT DOCUMENTS

| | | |
|---|---|---|
| EP | 1 057 751 A1 | 12/2000 |

(Continued)

*Primary Examiner*—Mickey Yu
*Assistant Examiner*—Steven A. Reynolds
(74) *Attorney, Agent, or Firm*—Hahn, Loeser & Parks, LLP

(57) ABSTRACT

A package for containing and dispensing wire from a coil of welding wire. The package having an outer layer with a bottom and an outer side wall having an upper edge defining a box opening for removing the wire from the package. The package further including an inner core positioned within the inner cylindrical opening of the wire coil wherein the inner core has a base supported by the package bottom and an oppositely facing core top. The core base being generally maintained relatively to the package bottom to prevent the core from "walking-up" the wire coil and the core top being allowed to tilt as the wire exits the package.

12 Claims, 13 Drawing Sheets

U.S. PATENT DOCUMENTS

| | | | | |
|---|---|---|---|---|
| 5,205,412 | A | 4/1993 | Krieg | |
| 5,277,314 | A | 1/1994 | Cooper et al. | |
| 5,314,134 | A | 5/1994 | Harris et al. | |
| 5,494,160 | A | 2/1996 | Gelmetti | |
| 5,553,810 | A | 9/1996 | Bobeczko | |
| 5,816,466 | A | 10/1998 | Seufer | |
| 5,819,934 | A | 10/1998 | Cooper | |
| 5,845,862 | A | 12/1998 | Cipriani | |
| 6,481,575 | B2 | 11/2002 | Cipriani | |
| 6,547,176 | B1 * | 4/2003 | Blain et al. | 242/423.1 |
| 6,564,943 | B2 | 5/2003 | Barton et al. | |
| 6,648,141 | B2 | 11/2003 | Land | |
| 6,745,899 | B1 | 6/2004 | Barton | |
| 6,857,521 | B2 * | 2/2005 | Cantu-Gonzalez | 206/397 |
| 2001/0006184 | A1 | 7/2001 | Ohike et al. | |
| 2003/0019776 | A1 | 1/2003 | Matsuguchi et al. | |

FOREIGN PATENT DOCUMENTS

| | | |
|---|---|---|
| JP | 62-111872 | 5/1987 |
| WO | PCT GB88/00488 | 12/1988 |
| WO | PCT EP94/00493 | 9/1994 |

* cited by examiner

WELDING WIRE PACKAGE

This application is a continuation of U.S. application Ser. No. 10/988,892, filed Nov. 15, 2004, now U.S. Pat. No. 7,377,388 the disclosure of such application is hereby incorporated by reference.

The present invention relates to welding wire packaging and more particularly to a welding wire package with an improved central core configuration which maintains its position relative to the base of the package.

INCORPORATION BY REFERENCE

Welding wire used in high production operations, such as robotic welding stations, is provided in a large package having over 200 pounds of wire. The package is often a drum or a box where a large volume of welding wire is looped in the package around a central core or a central clearance bore. During transportation a hold-down mechanism can be used to prevent the wire coil from shifting and to prevent the central core from shifting. To control the transportation and payout of the wire, it is standard practice to provide an upper retainer ring which can be utilized as a part of the hold-down mechanism to prevent wire shifting. One such package is shown in Cooper U.S. Pat. No. 5,819,934 which is incorporated by reference herein as background material showing the same. Another such packaging is shown in Kawasaki U.S. Pat. No. 4,869,367 which is also incorporated by reference herein for showing welding wire packages. Cipriani U.S. Pat. No. 6,481,575 shows a welding wire package which is also incorporated by reference for showing the same.

BACKGROUND OF INVENTION

In the welding industry, tremendous numbers of robotic welding stations are operable to draw welding wire from a package as a continuous supply of wire to perform successive welding operations. The advent of this mass use of electric welding wire has created a need for large packages for containing and dispensing large quantities of welding wire. A common package is a drum where looped welding wire is deposited in the drum as a wire stack, or body, of wire having a top surface with an outer cylindrical surface against the drum and an inner cylindrical surface defining a central bore that is coaxial to a central package axis. The central bore is often occupied by a cardboard cylindrical core, as shown in Cooper U.S. Pat. No. 5,819,934, extending about a core axis that is coaxial to the package axis. It is common practice for the drum to have an upper retainer ring that is used in transportation to stabilize the body of welding wire as it settles. This ring, as is shown in Cooper U.S. Pat. No. 5,819,934, remains on the top of the welding wire to push downward by its weight so the wire can be pulled from the body of wire between the core and the ring. In addition, a hold-down mechanism can be utilized to increase the downward force.

The welding wire in the package is in coils or convolutions wrapped about the package axis and the coil has a top and a bottom. The coil further includes radial inner and outer surfaces extending between the top and the bottom of the coil. As the welding wire is removed from the package, the wire is removed from the top coils or convolutions of wire wherein the top of the wire coil moves downwardly into the package. As a result, the top of the wire coil descends within the package and the outer and inner surfaces of the coil become shorter and shorter.

In order to work in connection with the wire feeder of the welder, the welding wire must be dispensed in a non-twisted, non-distorted and non-canted condition which produces a more uniform weld without human attention. It is well known that wire has a tendency to seek a predetermined natural condition which can adversely affect the welding process. Accordingly, the wire must be sufficiently controlled by the interaction between the welding wire package and the wire feeder. To help in this respect, the manufacturers of welding wire produce a wire having natural cast, wherein, if a segment of the wire was laid on the floor, the natural shape of the wire would be essentially a straight line; however, in order to package large quantities of the wire, the wire is coiled into the package which can produce a significant amount of wire distortion and tangling as the wire is dispensed from the package. As a result, it is important to control the payout of the wire from the package in order to reduce twisting, tangling or canting of the welding wire. This condition is worsened with larger welding wire packages which are favored in automated or semi-automated welding.

The payout portion of the welding wire package helps control the outflow of the welding wire from the package without introducing additional distortions in the welding wire to ensure the desired continuous smooth flow of welding wire. Both tangling or breaking of the welding wire can cause significant down time while the damaged wire is removed and the wire is re-fed into the wire feeder. In this respect, when the welding wire is payed out of the welding wire package, it is important that the memory or natural cast of the wire be controlled so that the wire does not tangle. The welding wire package comprises a coil of wire having many layers of wire convolutions laid from the bottom to the top of the package. These convolutions include an inner diameter and an outer diameter wherein the inner diameter is substantially smaller than the width or outer diameter of the welding wire package. The convolutions together form the radial inner and outer surface discussed above. The memory or natural cast of the wire causes a constant force in the convolutions of wire which is directed outwardly such that the diameter of the convolutions is under the influence of force to widen. The walls of the wire welding package prevent such widening. However, when the welding wire payout of the package, the walls of the package lose their influence on the wire and the wire is forced toward its natural cast. This causes the portion of the wire which is being withdrawn from the package to loosen and tend to spring back into the package thereby interfering and possibly becoming tangled with other convolutions of wire. In addition to the natural cast, the wire can have a certain amount of twist which causes the convolutions of welding wire in the coil to spring upwardly.

Payout devices or retainer rings have been utilized to control the spring back and upward springing of the wire along with controlling the payout of the wire. This is accomplished by positioning the payout or retainer ring on the top of the coil and forcing it downwardly against the natural springing effect of the welding wire. The downward force is either the result of the weight of the retainer ring or a separate force producing member such as an elastic band connected between the retainer ring and the bottom of the package. Further, the optimal downward force during the shipment of the package is different than the optimal downward force for the payout of the welding wire. Accordingly, while elastic bands or other straps are utilized to maintain the position of the payout or retainer ring during shipping, the weight of the retainer ring can be used to maintain the position of the payout relative to the wire coils during the payout or the wire.

In addition to the braking ring or retainer ring, which helps control the flow of wire from the package, welding wire packages can further include an inner core to help prevent the outgoing wire from looping across the central axis of the package. In this respect, the central core can be positioned in the wire package within the cylindrical inner region defined by the inner surface of the wire coil. The core is coaxial to a core axis in line with the central package axis. The inner core and the outer packaging together form a generally annular coil compartment wherein the wire can only move upwardly, not transversely of the package axis. In general terms, the central core produces an inner barrier for the wire coil to help direct the outgoing wire upwardly and out the top opening of the wire package such that one convolution of wire does not interfere with other convolution of wire.

The welding wire is further controlled by external wire management systems that can include a payout hat that is placed over the top opening of the package and which includes a central opening for the welding wire to pass through. This, alone with other forces and conditions, causes the exiting wire to move toward the central axis of the package as it travels toward this central opening. Further, while the wire is being removed, convolutions of wire are being removed wherein the outgoing wire is constantly moving around the central axis of the package. As a result of the inward movement, the wire tends to engage the inner core is it travels upwardly in the package and as a result of the constant movement about the central axis, this point of engagement with the central core constantly moves around the central core. This produces inward forces on the central core that constantly move about the central core. Further, as the wire moving toward the top opening, it also produces an upward force.

As can be appreciated, when the package is full of wire and the wire coil is nearly the same height of the central core, there is little or no space between the coil and the majority of the central core. This arrangement substantial prevents lateral and/or upward movement of the core relative to the central axis. As a result, the core is relatively stable with a full package. However, as the wire is removed from the package, the coil becomes shorter thereby exposing a greater portion of the top of the core. The lack of support by the inner surface of the coil near the top of the core allows core to move around the package axis at an angle to the package axis. More particularly, lack of support near the top cause the core to tilt about the package axis such the core axis near the top of the core becomes spaced radially outwardly from the package axis while the core axis near the bottom of the core is maintained closer to the package axis, but one side of the core bottom lifts from the bottom of the package. As the top of the wire coil nears the bottom of the package, this condition worsens such that the core axis near the top of the core moves further radially outwardly and the bottom of the core becomes looses even more of its engagement with the bottom such that it becomes unstable until the bottom of the core begins to "walk" up the inner surface of the core. Continued "walking" of the core will eventually cause the bottom of the core to reach the top of the coil. Once the bottom of the coil reaches the top of the coil it is free to move radially outwardly until it interferes with the flow of the outgoing wire and causes a tangle in the outgoing wire. As can be appreciated, a wire tangle will result in the welding operation being shut down until the tangle is removed. If the wire package is nearly empty, the nearly empty wire package may be replaced by a new wire package thereby wasting a significant amount of welding wire.

In order to overcome the shortcomings in cylindrical cores described above, conical central cores have been used to reduce the tendency of the core to tilt and lift as the wire is removed from the package. While the conical core may reduce the tilting and lifting actions of the core, it reduces the effectiveness of the core to help control the removal of the wire from the package. In this respect, a cylindrical core better directs the welding wire to the outlet of the package. Further, the tilting action of the core can have beneficial effects on the outgoing wire if it is controlled and if the bottom of the core is prevented from "walking" up the coil.

STATEMENT OF INVENTION

In accordance with the present invention, a welding wire package for containing and dispensing wire from a wire coil is provided which includes an inner core positioned within the inner cylindrical opening of the wire coil such that the core has a core base that is maintained laterally relative to the bottom of the package to prevent the core from "walking" up the wire coil and disrupting the outflow of the welding wire. In this respect, provided is a welding wire package having a bottom portion that provides a mounting structure to secure the base of the core relative to the bottom of the package while allowing only controlled movement of the top portion of core around the package axis as the wire is removed from the package.

An object of the present invention is the provision of a welding wire package which includes a core that generally maintains its position within the package during the unwinding of the wire in the package.

Another object of the present invention is the provision of a welding wire package which allows the wire to be wound from any known method into a wire package while still allowing the use of a stable inner core that helps guide the wire as it is removed from the welding package without disrupting the flow of the wire from the package.

A further object of the present invention is the provision of a welding wire package which includes a stable inner core that helps guide the wire as it is removed from the welding package without disrupting the flow of the wire from the package and which can be easily removed and discarded after the welding wire is consumed.

Yet a further object of the present invention is the provision of a welding wire package which includes a stable inner core that helps guide the wire as it is removed from the welding package without disrupting the flow of the wire from the package and which can be used in connection with hold-down mechanisms used for the transportation of the welding wire package.

Even yet another object of the present invention is the provision of a welding wire package which includes an inner core that will not "walk" up the wire coil as the wire is removed from the welding package.

Even yet a further object of the present invention is the provision of a welding wire package which includes components that are economical to produce, easy to use and discard after use.

BRIEF DESCRIPTION OF DRAWINGS

The foregoing objects, and more, will in part be obvious and in part be pointed out more fully hereinafter in conjunction with a written description of preferred embodiments of the present invention illustrated in the accompanying drawings in which.

DESCRIPTION OF PREFERRED EMBODIMENTS

Figure 1:
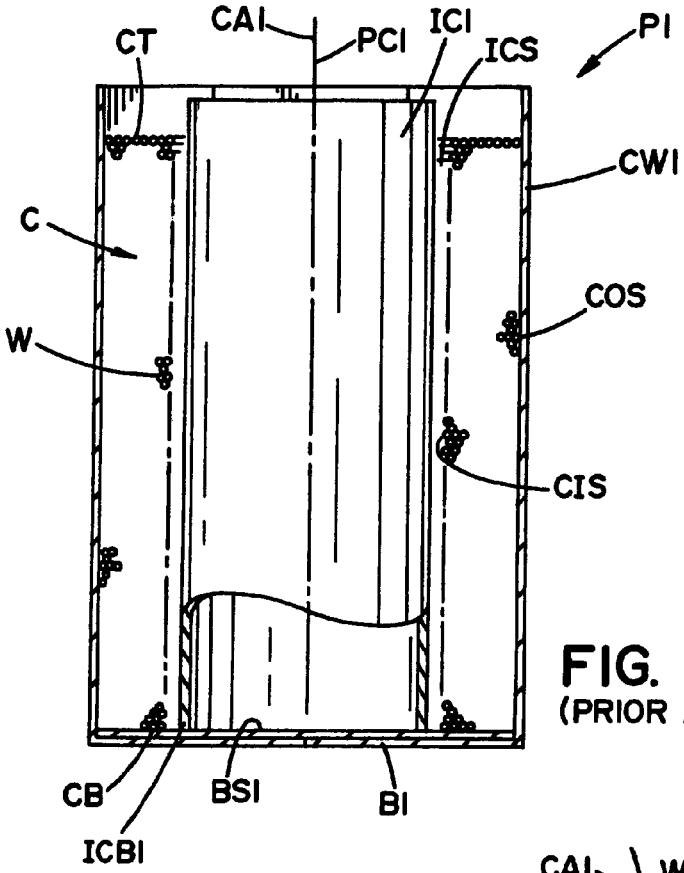
FIG. 1 (PRIOR ART)
FIG. 1 is a side sectional view of a prior art welding wire package which includes an inner core resting on the bottom of the package.
Figure 2:
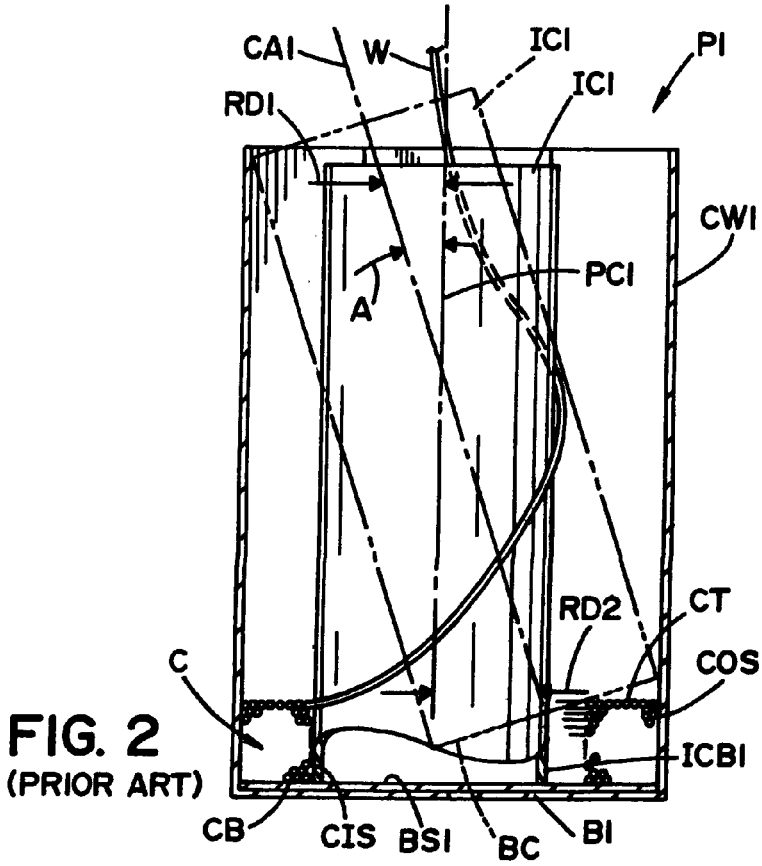
FIG. 2 (PRIOR ART)
FIG. 2 is a side sectional view of the prior art welding wire package shown in FIG. 1 wherein the core has "walked-up" the coil.
Figure 3:
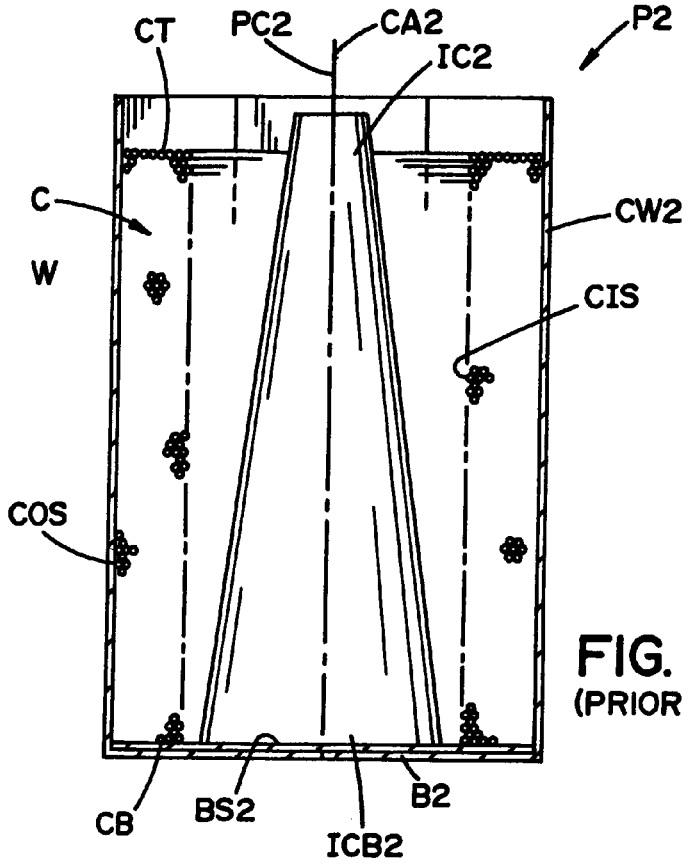
FIG. 3 (PRIOR ART)
FIG. 3 is a side sectional view of another prior art welding wire package which includes a conical inner core resting on the bottom of the package.
Figure 4:
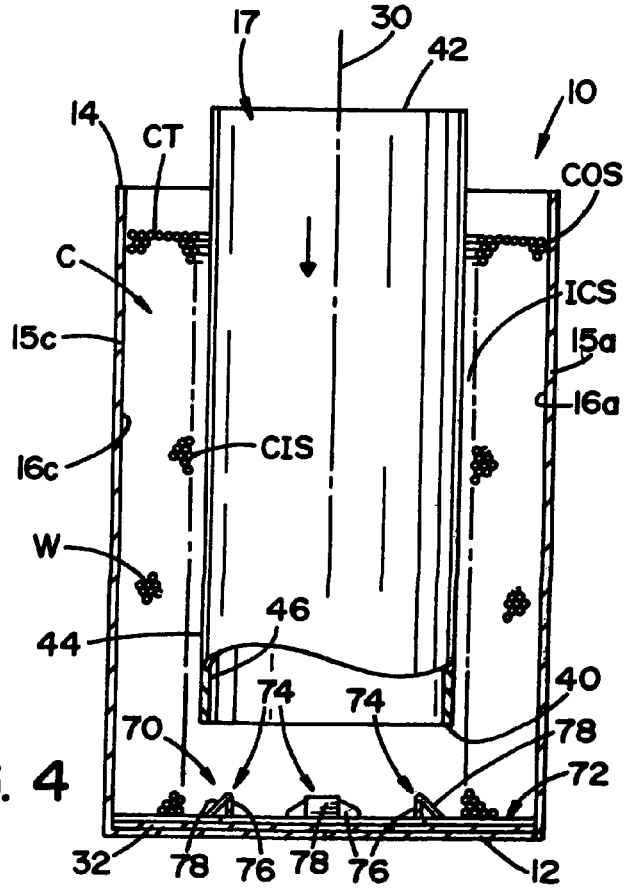
FIG. 4 is a side sectional view of a welding wire package according to the present invention wherein an inner core is being inserted into the package which contains a coil of wire.
Figure 5:
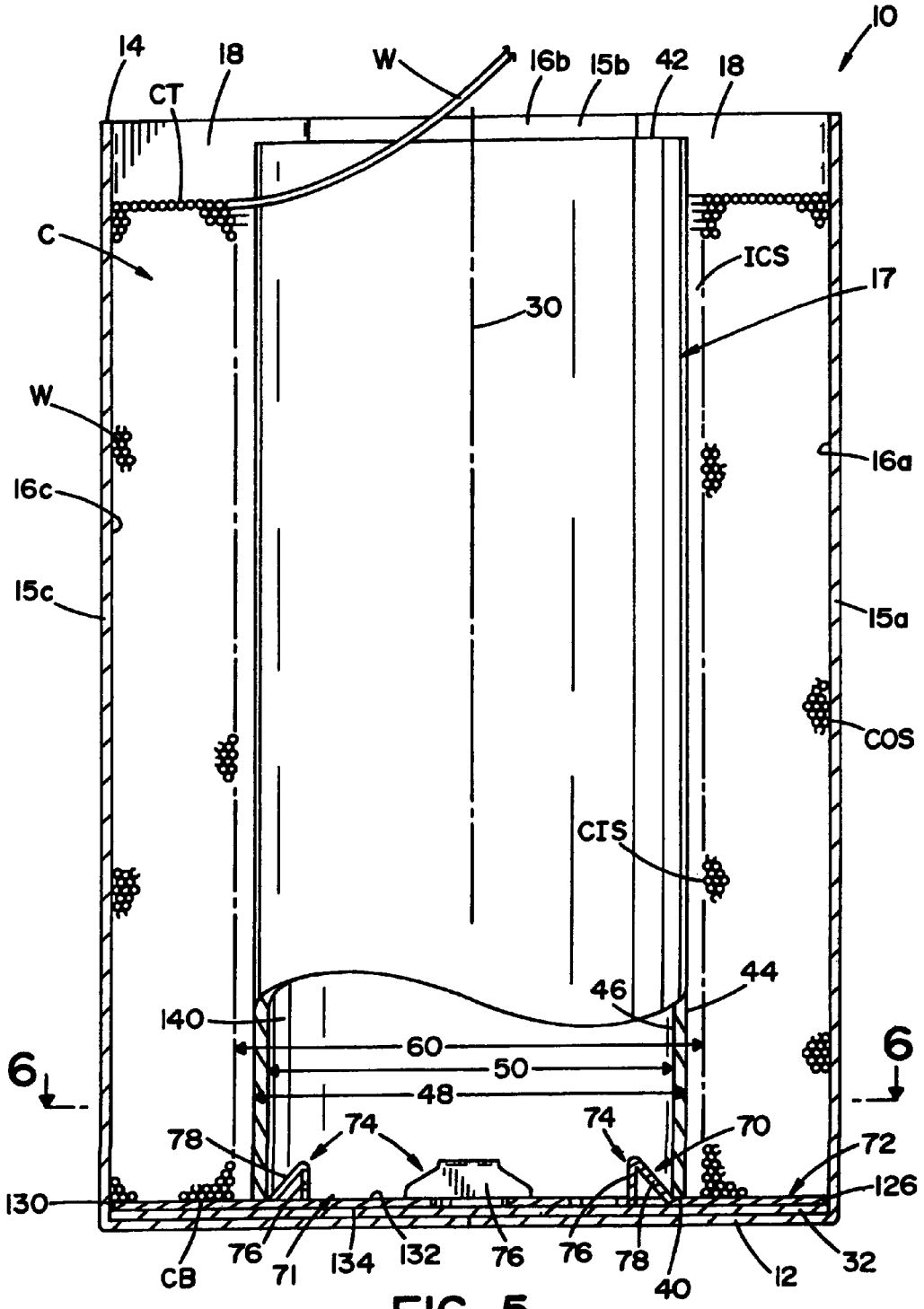
FIG. 5 is an enlarged sectional view of the package shown in FIG. 4 wherein the core is a retained condition.
Figure 6:
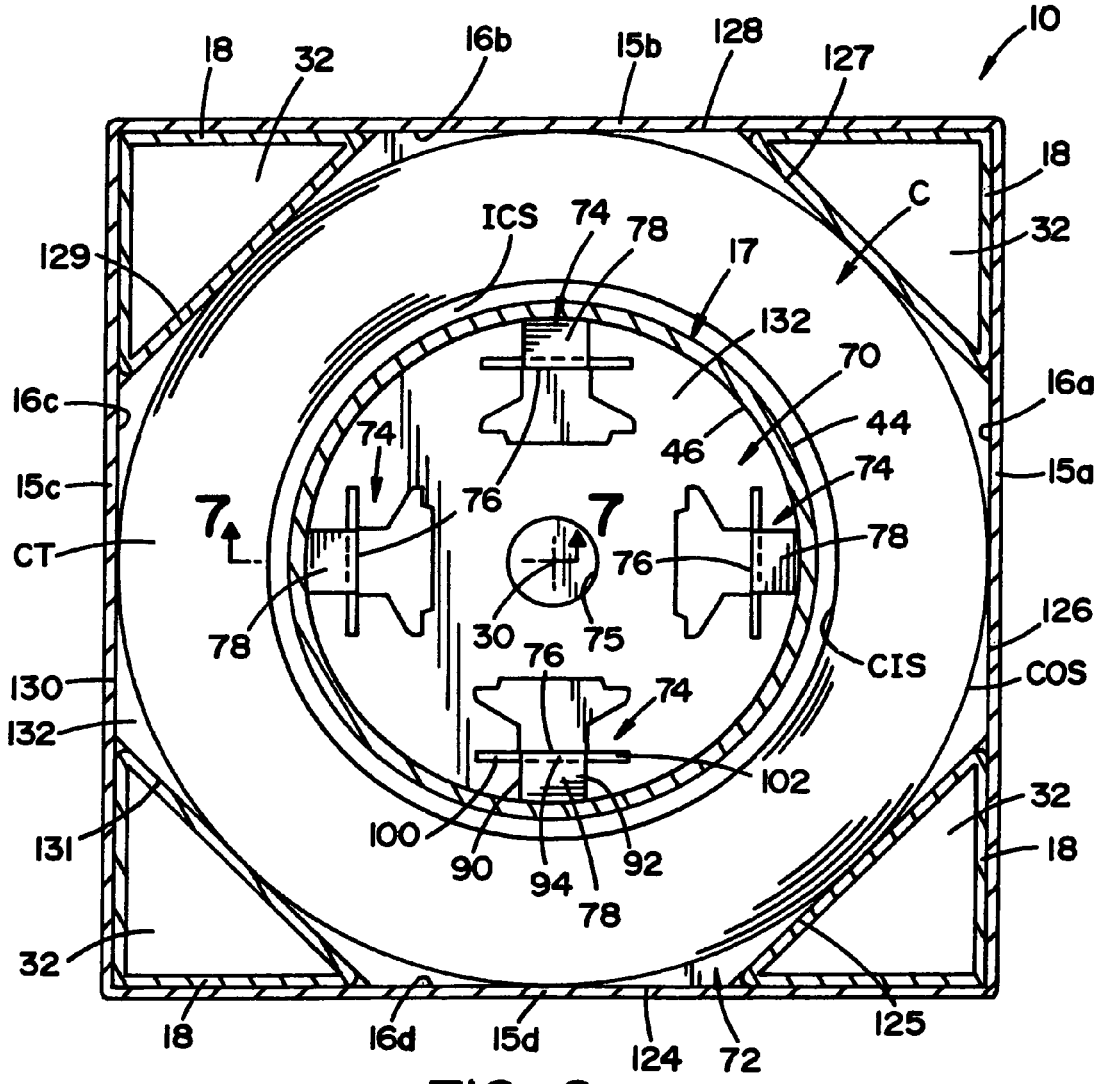
FIG. 6 is a sectional view taken generally along line 6-6 of FIG. 5.
Figure 7:
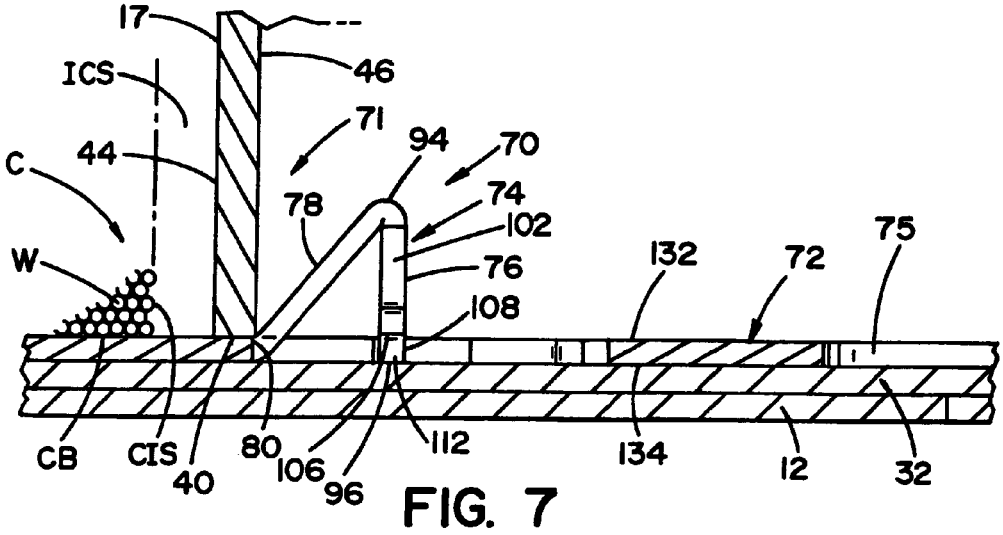
FIG. 7 is a cross sectional view taken generally along line 7-7 of FIG. 6.

Referring now in greater detail to the drawing wherein the showings are for the purpose of illustrating preferred embodiments of the invention only, and not for the purpose of limiting the invention, FIGS. 1-3 show prior art welding wire packages which include an inner core that merely rests on the base of the package. In this respect, FIGS. 1-2 show a prior art package P1 and FIG. 3 shows a prior art package P2. Package P1 has a cylindrical side wall CW1 and a round base B1. Package P1 further includes an inner core IC1 which is cylindrical and has a base ICB1 that rests on a base sheet BS1 on bottom B1. In FIG. 1, package P1 is full of a welding wire W packaged as a wire coil C and a core axis CA1 of inner core IC1 in line with a package axis or center PC1. Coil C has a coil top CT, a coil bottom CB, a coil inner surface CIS and a coil outer surface COS wherein coil inner surface CIS defines an inner cylindrical space ICS coaxial with package axis PC1. Coil bottom CB is resting on base sheet BS1 and coil outer surface COS is supported by side wall CW1.

The welding wire coil has many layers of wire convolutions laid from the bottom to the top of the package. These convolutions are placed in the package by a machine that extends into the package and rotationally positions or places wire on the coil top. As can be appreciated, the wire placement begins at the bottom of the package and works its way to the top of the package. The inner core is therefore positioned in the package after the wire is deposited in the package. The convolutions include an inner diameter and an outer diameter wherein the inner diameter is substantially smaller than the width or outer diameter of the welding wire package. The convolutions together form coil inner surface CIS and coil outer surface COS. As the welding wire is removed from package P1, the wire convolutions can wrap around the inner core one after another as is shown in FIG. 2. As can be appreciated, core IC1 helps direct the wire out of the package by preventing the wire from crossing over package center PC1 such that one convolution can contact another convolution and cause a tangling. As the wire is removed more and more of core IC1 becomes exposed to the outgoing wire and becomes unsupported. As coil top CT moves down toward bottom B1, core IC1 can become unstable and core base ICB1 can begin to lift away from base sheet BS1.

Once the core becomes unstable, it can "walk up" coil inner surfaces CIS and interfere with the outflow of the welding wire. In this respect, the lack of support by the inner surface CIS above coil top CT allows the core to move more freely in the package. More particularly, this core movement relative to the outer packaging, which will hereinafter be referred to "rotational tilting," is when the core moves such that core axis CA1 essentially moves around package axis PC1. However, portions of the core axis near the top of the core move around package axis PC1 at radial distance that is different than portions of the core near the bottom of the core. This produces a tilted motion, or rotational tilting, wherein the core is at an angle A from the package axis. For example, as is shown in FIG. 2, core IC1 is tilted such that core axis CA1 near the core top is spaced from package axis PC1 a first radial distance RD1 and the core axis is spaced a second radial distance RD2 from the package axis near the core bottom wherein the core axis rotation angle is A to the package axis. As can be appreciated, angle A can change, and does change, based on the amount of wire in the package. In this respect, the more wire that is removed from the package worsens the rotational tilting wherein angle A increases. As can be appreciated, since the core bottom is flat, a portion of the core bottom lifts from base sheet BS1 during the rotational tilting thereby reducing core stability. As coil top CT approaches base sheet BS1, the rotation tilting causes the base corner BC to contact coil inner surfaces CIS and the bottom of the core begins to "walk up" the inner surface of the core. Continued "walking" of the core will eventually cause core base ICB1 to reach coil top CT. Once core base ICB1 reaches core top CT it is also free to move radially outwardly and if it does, it will interfere with the flow of the outgoing wire and result in a wire tangle. As can also be appreciated, a wire tangle will result in the welding operation being shut-down until the tangle is removed. If the wire package is nearly empty, the nearly empty wire package may be replaced by a new wire package thereby wasting a significant amount of welding wire.

FIG. 3 shows a conical core which has been developed to try and minimize rotational tilting. In this respect, shown is a welding wire package P2 having a cylindrical side wall CW2 and a round base B2. Package P2 further includes an inner core IC2 which is conical and has a base ICB2 that rests on a base sheet BS2 on bottom B2. Package P2 is shown to be full of welding wire W packaged as wire coil C as described above. Core IC2 also has a core axis CA2 which is in line with a package axis or center PC2. The conical configuration of core IC2 produces a spacing between the coil and the core that varies from the top of the core to the bottom of the core. As a result, the core has a different influence on the outgoing wire as the core top descends within the package. While this configuration can reduce rotational tipping, it does not eliminate this movement and further, the benefits of the core's influence on the outgoing wire is substantially lost.

FIGS. 4-9 illustrate a welding wire package 10 wherein a wire W is stored in and payed out of package 10 having a bottom 12, a top 14, side walls 15*a*, 15*b*, 15*c* and 15*d* having an inner surfaces 16*a*, 16*b*, 16*c* and 16*d*. Package 10 can further include corner supports 18 and even an inner liner known in the art, which is not shown. The inner liner can include, but is not limited to, octagonal inner liners known in the art. Further, package 10 can be a drum style package having a cylindrical configuration or other packaging configurations known in the art. Package 10 further includes an inner core 17 generally concentric with surface 16.

As is known and as is described above, package 10 is loaded with wire W at the wire manufacturing facility by looping the wire into the package. This looping process winds the convolutions of wire into a coil C of wire having a body wrapped about a coil or package axis 30. Coil C has a coil top CT, a coil bottom CB, a coil inner surface CIS and a coil outer surface COS wherein coil inner surface CIS defines an inner cylindrical space ICS coaxial with package axis 30. Package 10 can have a base sheet 32 wherein coil bottom CB rests on base sheet 32 and coil outer surface COS is supported by inner surfaces 16*a*, 16*b*, 16*c*, and 16*d* of side wall 15*a*, 15*b*, 15*c*, and 15*d*, respectively. While not shown, package 10 can also include an inner packaging layer which separates COS from the side walls. Further, coil bottom CB can rest directly on bottom 12 and/or additional layers can be utilized which will be discussed in greater detail below. The wire is looped in a manner such that it has a cast to facilitate payout of the wire with a minimum of tangles and/or twists in the wire. This produces an upward springing effect which must be controlled during both the transport of packaging 10 and during the unwinding of the welding wire which will also be discussed in greater detail below.

Once the wire has been looped in package 10, inner core 17 can be positioned in the packaging. More particularly, inner core 17 has a bottom edge 40, a top edge 42, an outer surface 44 and an inner surface 46. As is shown, core 17 can be cylindrical with an outer sectional diameter 48 and an inner sectional diameter 50. However, core 17 could have other cross-sectional configurations including, but not limited to, polygonal cross-sectional configurations. Further, core 17 can be manufactured using any technique and/or material known in the art. Core 17 is positioned by lowering the core into the cylindrical opening defined by core inner surface CIS. As can be appreciated, outer diameter 48 must be approximately equal or less than an inner diameter 60 of inner surface CIS so that the core can be lowered into position.

As core 17 is lowered into position in the package, it is received by a core stabilizer 70 and generally maintained in a retained condition 71 by the stabilizer, which will be discussed in greater detail below. As can be appreciated, stabilizer 70 can be a separate component, an extension of base sheet 32 or an extension of bottom 12 without detracting from the invention of this application. As shown, stabilizer 70 is a separate component of package 10 and includes a base 72 and four retainers 74 that are spaced about axis 30. While four retainers are shown, there can be more or less than four retainers without detracting from the invention of this application. Stabilizer 70 can further include a central opening 75 for a hold-down mechanism that will be discussed in greater detail below.

Retainers 74 each include a vertical member 76 and a cross member 78, both of which can be cut from base 72. In this respect, vertical member 76 and cross member 78 can be a unified component extending from base 72 at a base edge 80. Cross member 78 is rectangular and includes side edges 90 and 92 that are parallel to one another and extend between base edge and a mid-fold 94 which joins members 76 and 78 and which allow the members to pivot relative to one another. Vertical member 76 extends between mid fold 94 and a tab edge 96. More particularly, member 76 includes side edges 100 and 102 that are non-parallel and which extend away from one another from mid-fold 94 toward tab edge 96 to form retainer seats 104 and 106. Member 76 further includes a tab 108 between seats 104 and 106 that extends beyond seats 104 and 106 and is defined by tab edge 96 and tab sides 110 and 112 wherein tab 108 has a tab width 114 between tab sides 110 and 112 and a tab length 116 between seats 104/106 and tab edge 96. Retainers 74 further include locking slots 120 and 122 shaped to receive a portion of tab 108 to maintain tabs 74 in an upwardly extending position such that vertical member 76 is generally perpendicular to base 72 and cross member 78 extends at an angle between mid-fold 94 and base 72 wherein mid-fold 94 is spaced furthest from base 72.

Figure 8:
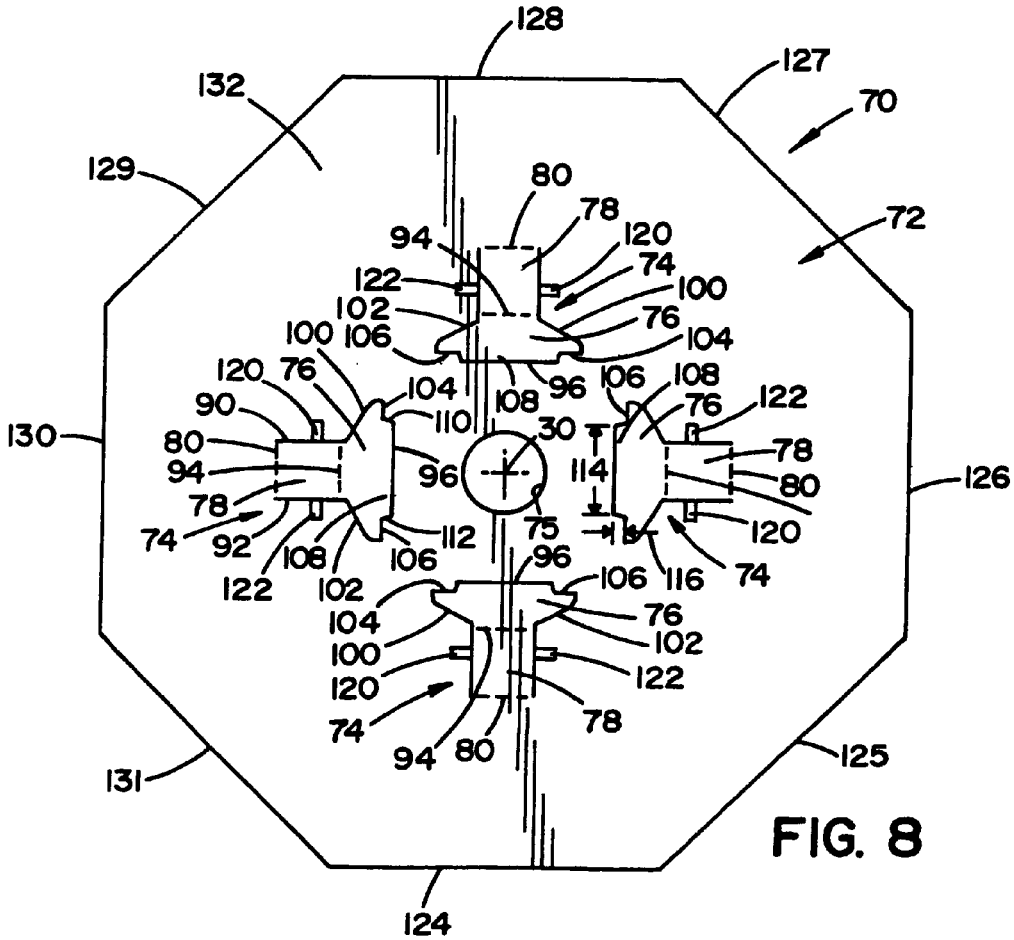
FIG. 8 is an enlarged top plan view of a stabilizer with pre-cut retainers which is shown in the package shown in FIG. 1.
Figure 9:
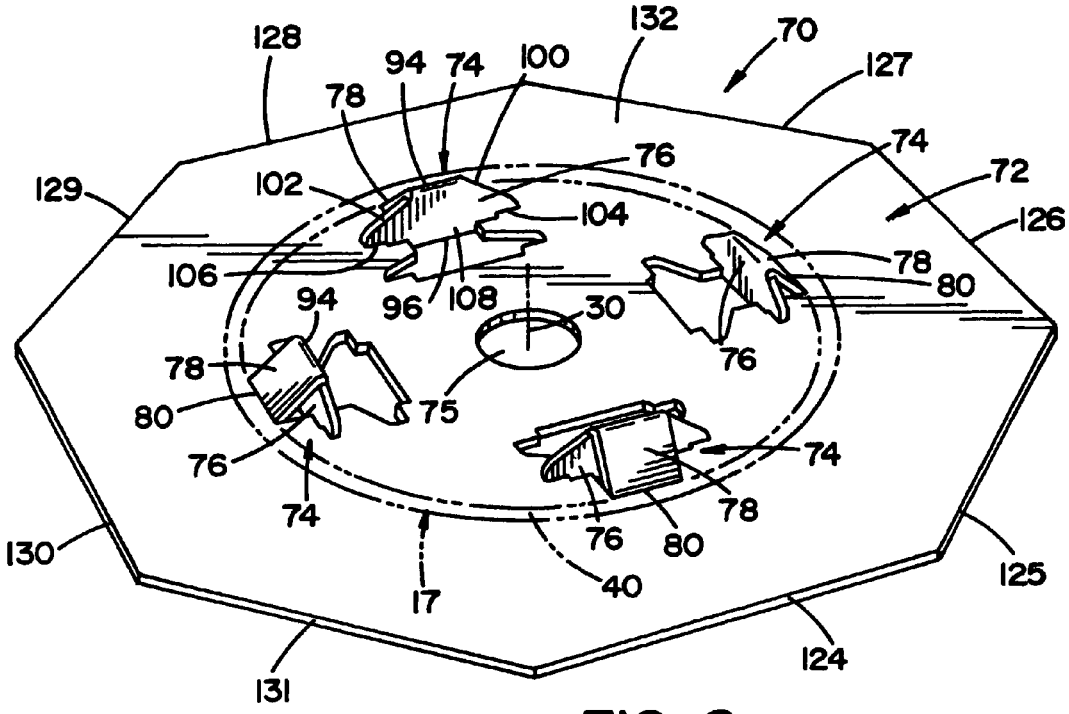
FIG. 9 is perspective view of the stabilizer shown in FIG. 8 with the retainers folded into a receiving position.

As is shown in FIG. 8, retainers can be cut from base 72 such that the retainers are a portion of the base. For retainers cut from base 72, they are first partially separated from base 72 by rotating the retainer about edge 80. Then, the retainers are folded about mid-fold 94, which can include a score, and tab 108 is then positioned in slots 120 and 122 until seats 104 and 106 engage base 72. While retainers are shown to be cut from base 72, it should be appreciated that they can also be a separate component attached to base 72 without detracting from the invention of this application. The inter-engagement between tab 108 and slots 120 and 122 along with the engagement by seats 104 and 106 retain tab 74 in an operating position as is shown in FIG. 9. Stabilizer 70 is fixed relative to the coil C so that it can control the movement of core 17 which will be discussed in greater detail below. More particularly, the weight of wire W and/or other package components can be used to fix the stabilizer relative to the coil. As is shown, base 72 of stabilizer 70 has outer edges 124-131 and is sized such that these edges engage the inner surfaces 16 of walls 15 and corner supports 18. Base 72 further includes upper surface 132 and lower surface 134 wherein coil bottom CB is on surface 132 such that the weight of wire W is resting on base 72 and further prevents movement of the stabilizer relative to the coil.

As core 17 is lowered into the central opening of the coil, it is directed toward tabs 74 such that bottom edge 40 engages cross members 78 and/or is closely adjacent to bases 80 of the retainers. Once in position, the retainers are substantially within an inner portion 140 of core 17 which advantageously separates the retainers from the wire coil to prevent interference with the unwinding of the wire from the package. Essentially, retainers engage bottom edge 40 and/or inner surface 46 of core 17 to control the movement of the core. By including a plurality of retainers about the base of the core, the base is substantially prevented from moving transversely relative to the package axis in all directions transverse to axis 30, which helps prevent the bottom edge of the core from engaging inner surface CIS of the wire coil, thereby preventing unwanted "walking" of the core up the wire coil. Further, since the core is not permanently attached to the base of the package, it can be easily removed and discarded, which can help minimize the cost of discarding the used packaging, especially if unlike materials are used for the outer packaging and the core. Again, as is stated above, core 17 can be made from any known materials in the art, which can include materials that are not similar to the materials used for the outer packaging of package 10. Even if common materials are used, removal of the core can help make the discarded packaging materials easier to compact without the need for mechanical compacting equipment.

In operation, core 17 functions similar to prior art cores, wherein outer surface 44 helps direct wire W upwardly as the wire is unwound from the wire coil. However, stabilizer 70 allows only controlled rotational tilting of the core while the wire is unwound or payed out. As stated above, some rotational tilting can be advantageous in the control of the wire as it is unwound from the packaging. However, when the rotational tilting becomes violent or uncontrolled, it can interfere with the smooth removal of wire and/or can cause the core to "walk-up" the coil and eventually cause a wire tangle. Even though retainers can allow some movement of the bases of the core relative to bottom 12, including some lifting of bottom edge 40 of core 17, it is substantially controlled movement and the bottom edge is prevented from contacting the inner surface of the coil.

In the following discussions concerning other embodiments of the present inventions, like components will be referenced by the same reference numbers as discussed above.

Figure 10:
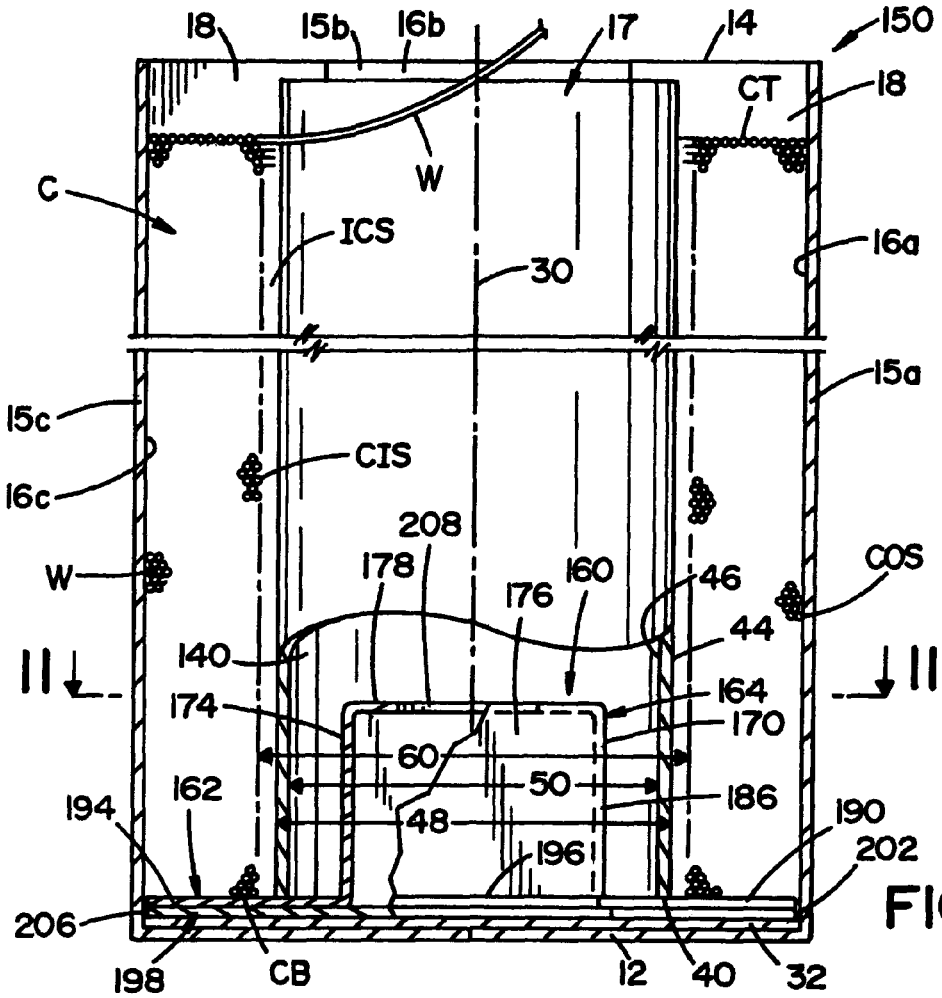
FIG. 10 is a side sectional view of another embodiment of the present invention.
Figure 11:
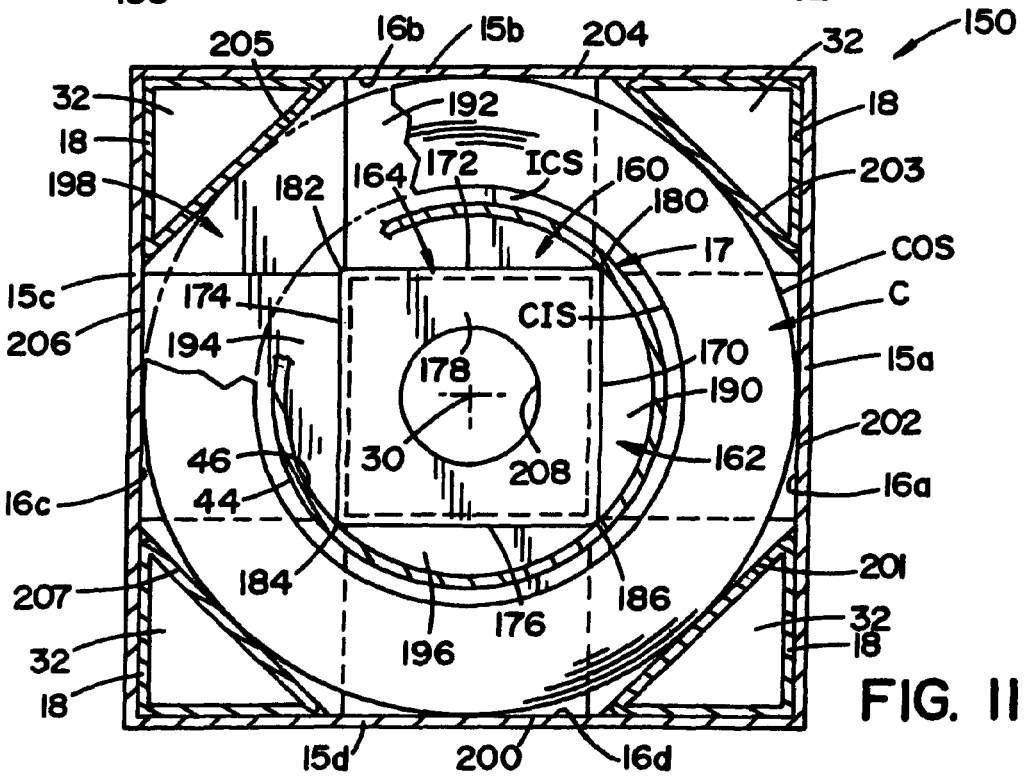
FIG. 11 is a sectional view of the package shown in FIG. 10 taken along lines 11-11 in FIG. 10.
Figure 12:
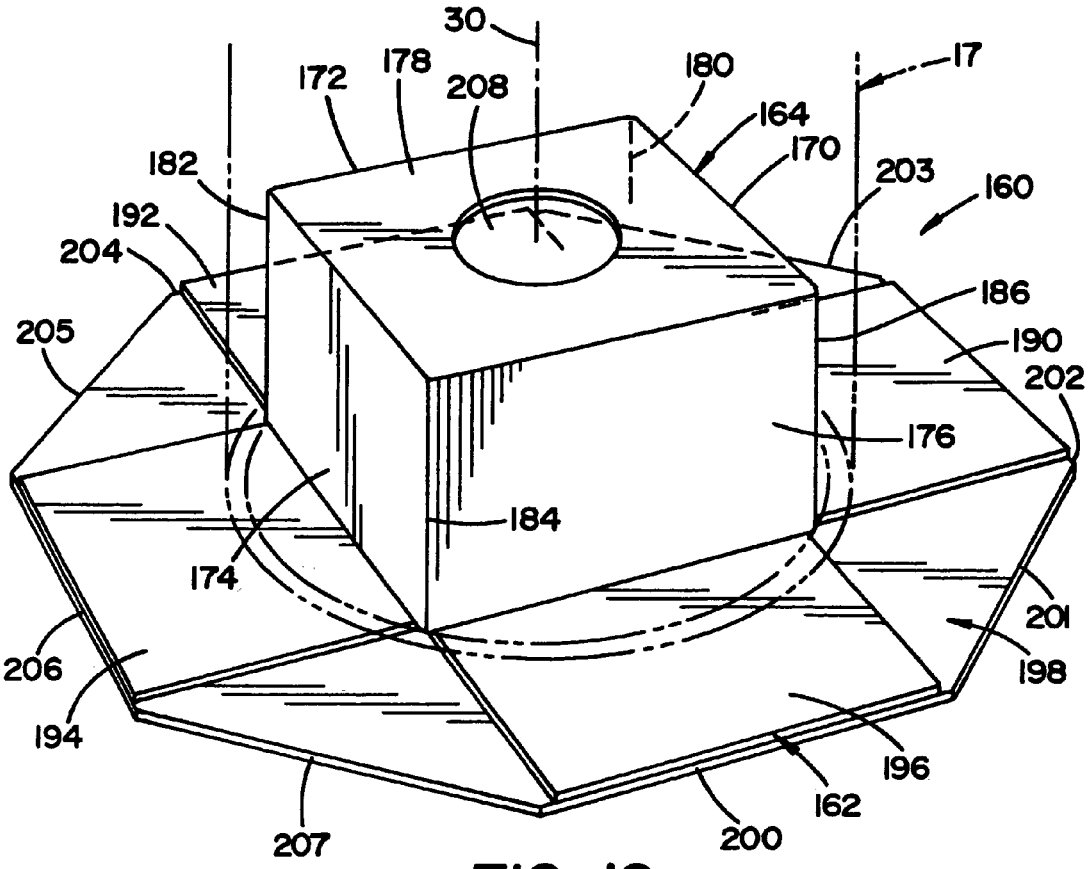
FIG. 12 is an enlarged perspective view of another stabilizer which is shown in FIG. 11.

Referring to FIGS. 10-12, package 150 is shown, which includes a coil stabilizer 160 and the same outer configuration as discussed above. Again, while this package design and the following designs are being described in connection with square box packages, the invention of this application is not limited to square box packages and has broader applications. Stabilizer 160 includes a base 162 and an upward protrusion 164 extending from base 162. Upward protrusion 164 includes four vertically extending side walls 170, 172, 174 and 176 and a top 178. While a square cross-sectionally configured protrusion is shown, it should be noted that other protrusions, including other polygonal configurations, could be used without detracting from the invention of this application. Protrusion 164 further includes a corner edge 180 between walls 170 and 172, a corner edge 182 between walls 172 and 174, a corner edge 184 between walls 174 and 176 and a corner edge 186 between walls 176 and 170. As core 17 is lowered into the central opening of the coil, it is directed toward protrusion 164 such that the protrusion enters inner portion 140 and corners 180, 182, 184 and 186 engage inner surface 46 of core 17. The bottom edge 40 rests on base 162. Once in position, the protrusion is within inner portion 140, which again advantageously separates the stabilizer from the wire core to prevent interference with the unwinding of the wire from the package. Essentially, the frictional engagement between corners 180, 182, 184 and 186 and inner surface 46 maintain the position of the core during the payout of the wire. As with the retainers described above, the protrusion controls the movement of the core thereby preventing the core from moving transversely relative to the package axis in all directions transverse to package axis 30, which helps prevent the bottom edge of the core from engaging the wire coil thereby preventing unwanted "walking" of the core up the wire coil. While stabilizer 160 can be an extension of base sheet 32 (not shown), it can also be a separate component and can include flaps 190, 192, 194 and 196 extending from walls 170, 172, 174 and 176, respectively, which are positioned between the bottom of the coil and bottom 12 without the base sheet.

Package 150 can further include an additional base sheet 32 and/or an additional stabilizer sheet 198 positioned between sheet 32 and flaps 190, 192, 194 and 196. As stated above, the weight of wire W and/or other package components can be used to fix the stabilizer relative to the coil. As is shown, sheet 198 has outer edges 200-207 and is sized such that these edges engage the inner surfaces 16 of walls 15 and corner supports 18.

Top 178 can include a hold-down opening 208 for a hold-down mechanism (not shown) that can be used with package 150 to prevent wire shifting during the transportation of package 150.

Figure 13:
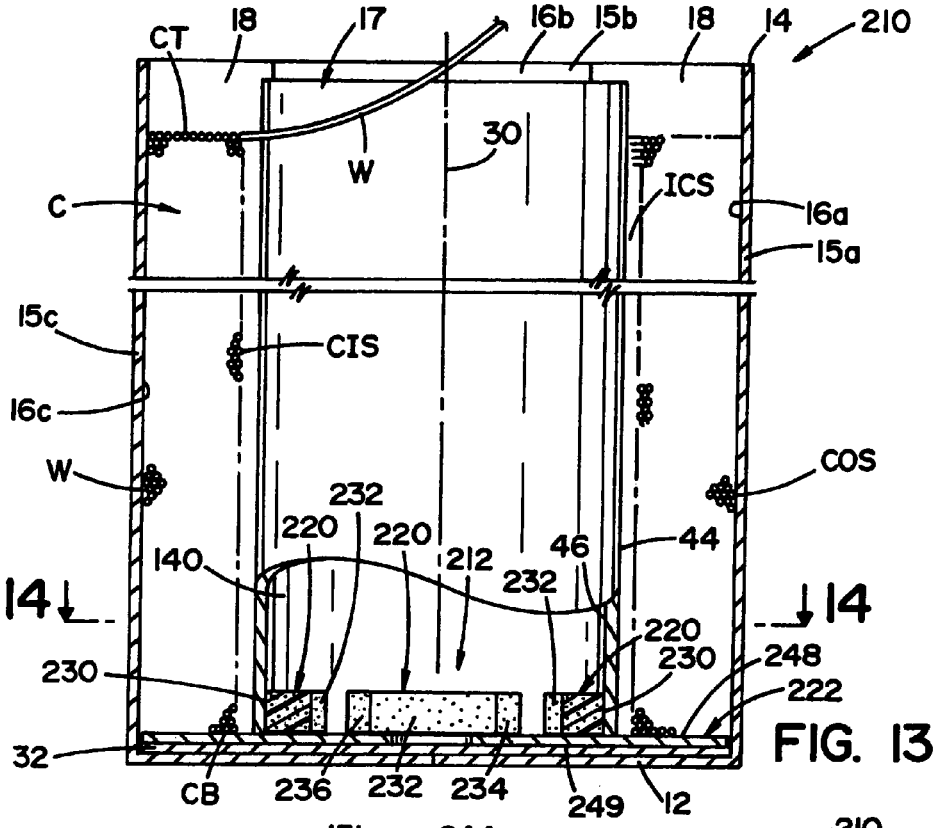
FIG. 13 is a side sectional view of yet another embodiment of the present invention.
Figure 14:
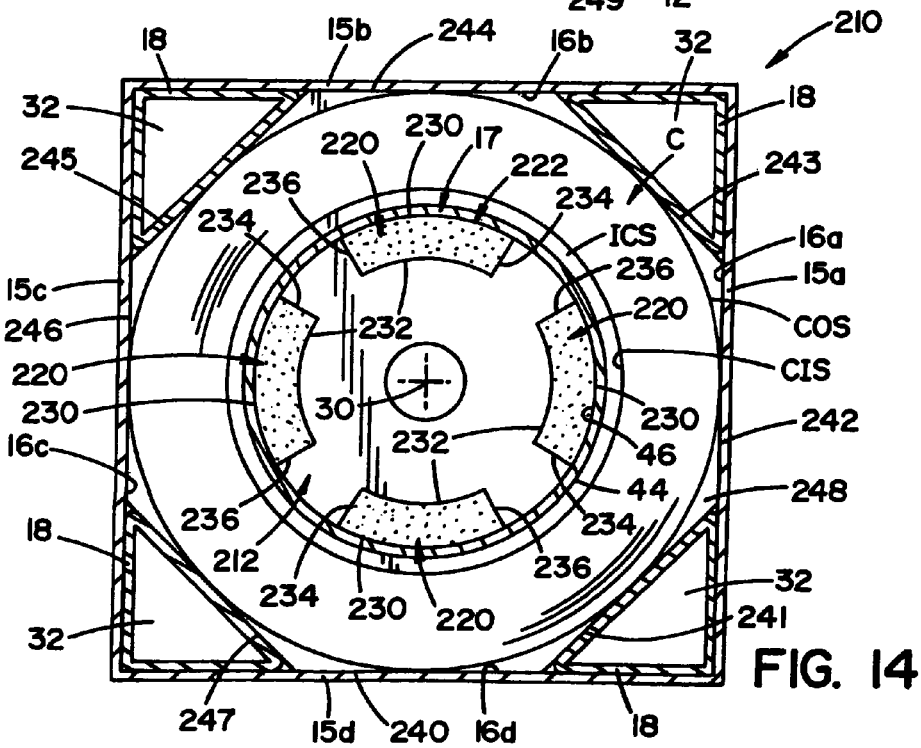
FIG. 14 is a sectional view taken along line 14-14 in FIG. 13.
Figure 15:
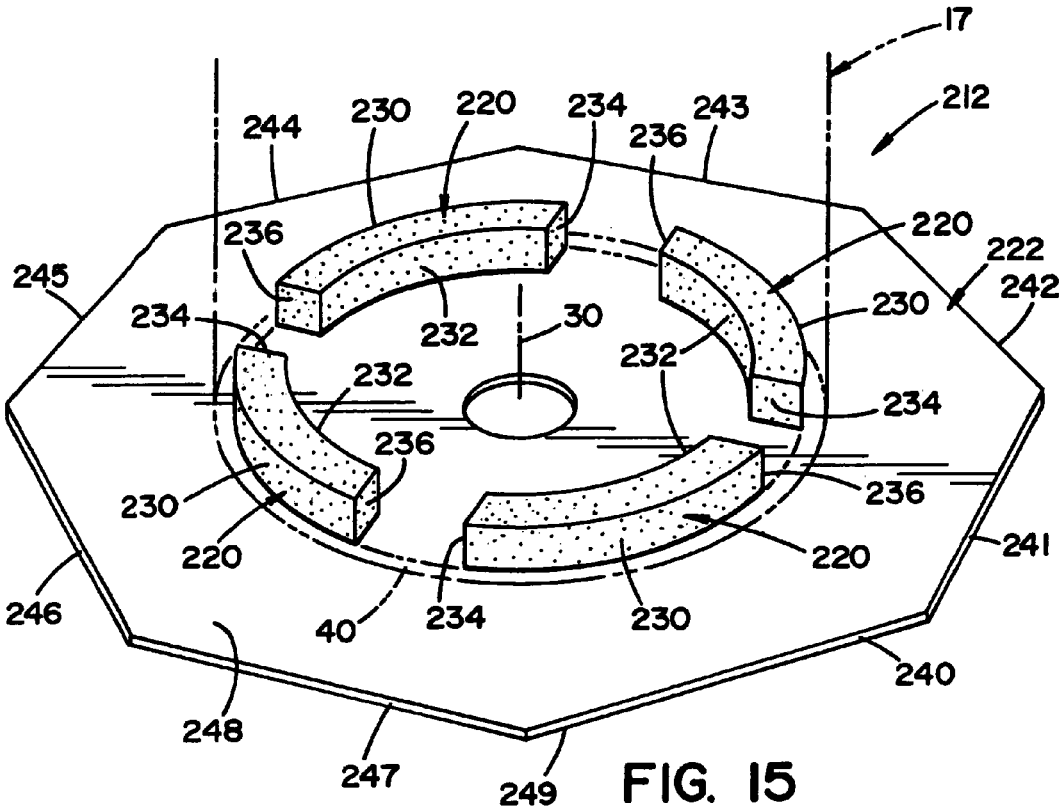
FIG. 15 is an enlarged perspective view of yet another stabilizer as is shown in FIG. 13.

Referring to FIGS. 13-15, package 210 is shown, which includes a stabilizer 212. More particularly, stabilizer 212 includes retainers or upward protrusions 220 that are spaced about package axis 30 and which extend from a base 222. As with the other embodiments, protrusions 200 can be connected to a separate base or can be an extension of bottom 12 and/or base sheet 32 (not shown) without detracting from the invention of this application. Retainers 220, in this embodiment, are separate components attached to base 222 that are made from a compressible foam. However, while foam is preferred, retainers 220 can be made from other materials known in the art including, but not limited to, cardboard. Retainers have a radial outer edge 230, a radial inner edge 232 and sides 234 and 236. Outer edge 230 is arcuate having a curvature corresponding to inner surface 46 of core 17. While not required, by including an arcuate outer edge, retainers 220 have increased surface contact with inner surface 46 of the core thereby increasing the ability of the retainers to maintain the desired control of the core even with a minimal height. As can be appreciated, the costs to both produce and discard a component can often be reduced by minimizing the size of the component.

As core 17 is lowered into the central opening of the coil, it is directed toward retainers 220 such that the retainers enter inner portion 140 and outer surfaces 230, engage inner surface 46 of core 17. The bottom edge 40 of core 17 rests on base 222. Once in position, the retainers are within inner portion 140 which again advantageously separates the stabilizer from the wire core to prevent interference with the unwinding of the wire from the package. As with the retainers described above, the protrusion controls the movement of the core thereby preventing the core from moving transversely relative to package axis 30 in all directions transverse to the package axis which helps prevent the bottom edge of the core from engaging the wire coil thereby preventing unwanted "walking" of the core up the wire coil. Again, the weight of wire W and/or other package components can be used to fix the stabilizer relative to the coil. As is shown, base 222 has outer edges 240-247 and is sized such that these edges engage the inner surfaces 16 of walls 15 and corner supports 18. Base 222 further includes upper surface 248 and lower surface 249 wherein coil bottom CB rests on surface 248 such that the weight of wire W is resting on base 222 and further prevents movement of the stabilizer relative to the coil.

Figure 16:
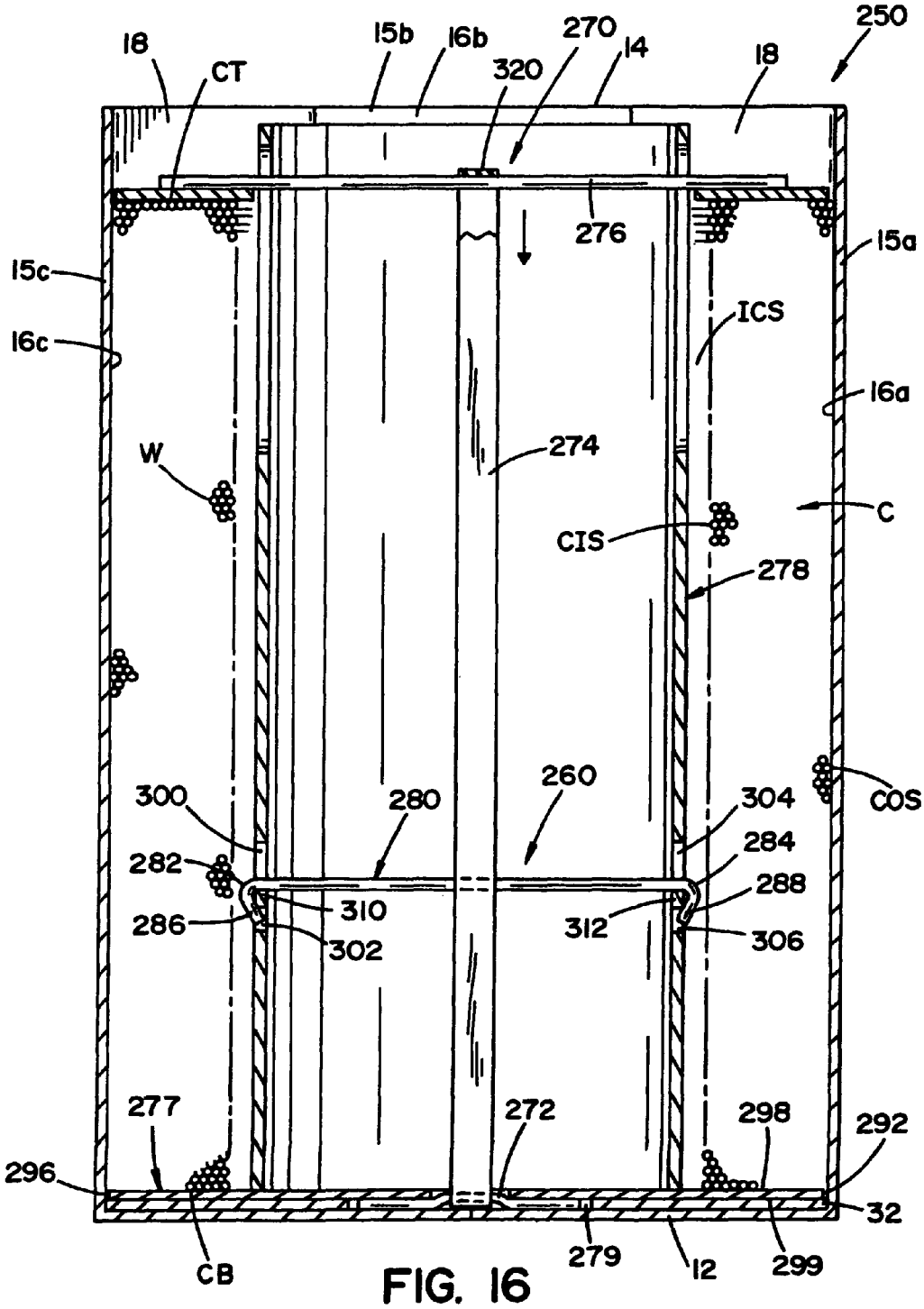
FIG. 16 is a side sectional view of yet a further embodiment of the present invention shown in a transport condition.
Figure 17:
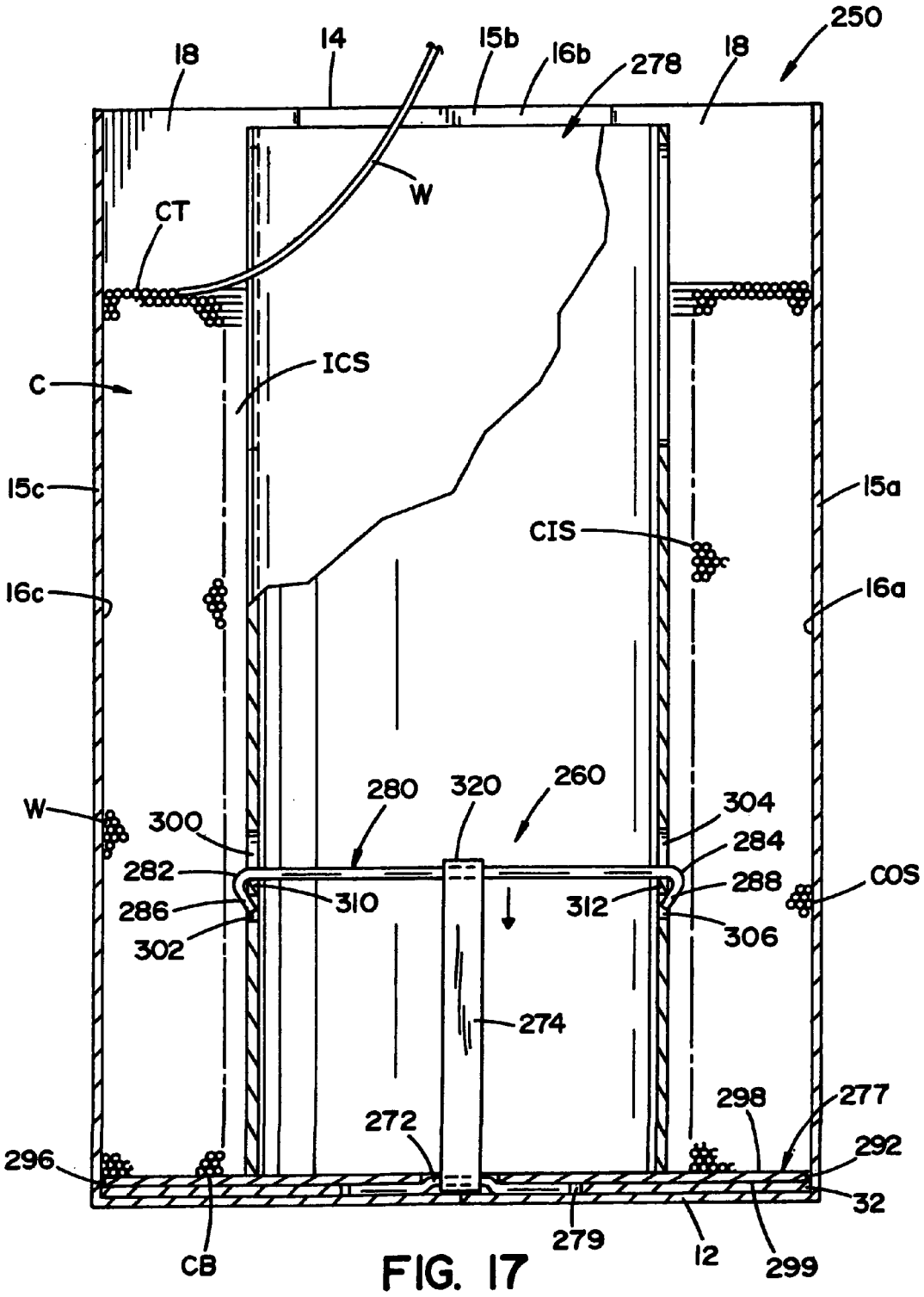
FIG. 17 is a side sectional view of the package shown in FIG. 16 in an unwinding condition; and, FIG. 18 is a partially sectioned perspective view of a further stabilizer shown in the package shown in FIG. 16.
Figure 18:
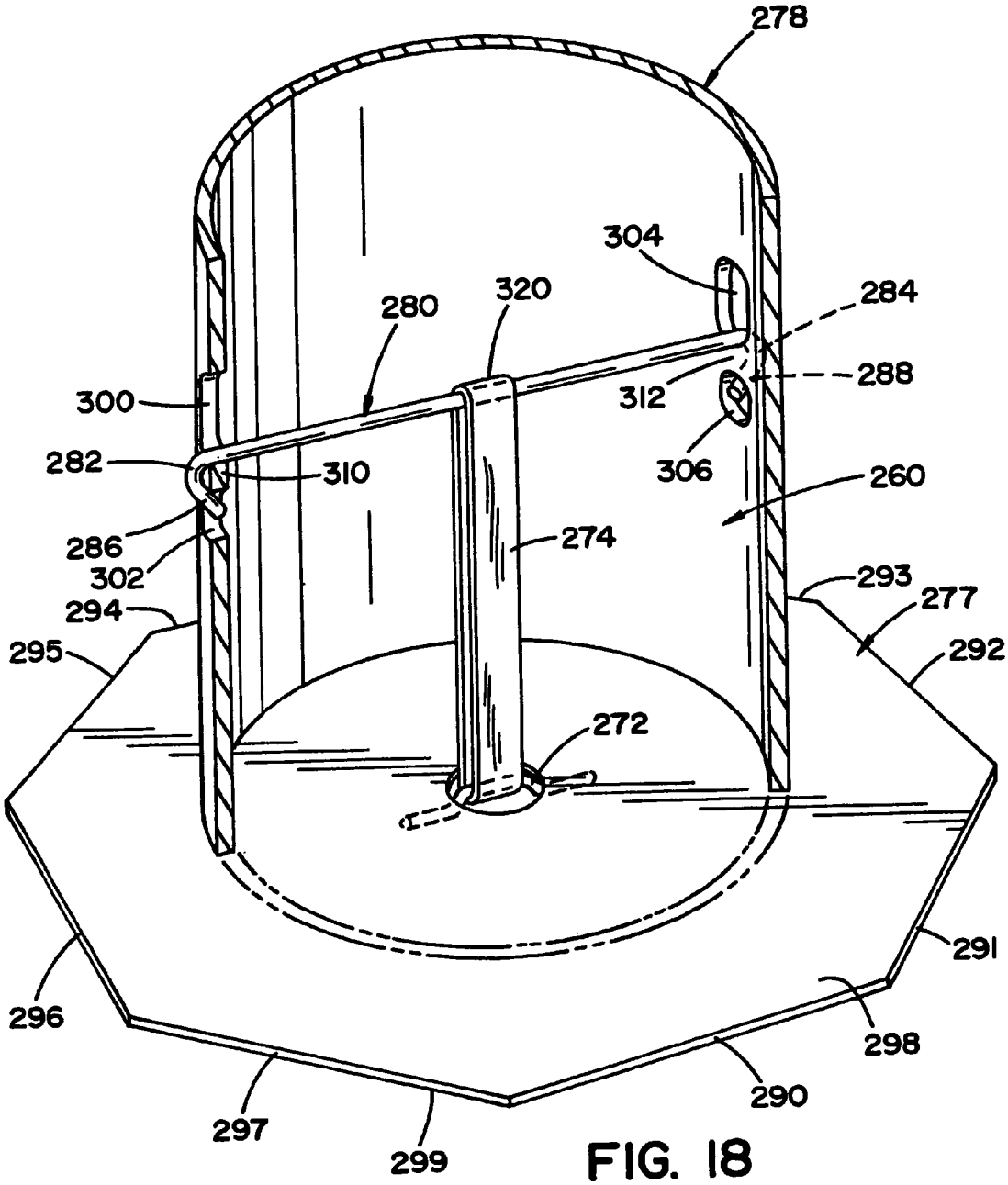

With reference to FIGS. 16-18, a package 250 is shown having a stabilizer 260. As with the embodiments described above, package 250 can include a hold-down mechanism 270 having a hold-down bar 272, a force producing member 274 and a top bar 276. As is stated above, the hold-down mechanism prevents the shifting and/or upward springing of the wire in the wire coil during transport. This is accomplished by producing a downward force on top surface CT of coil C. More particularly, hold-down bar 272 is maintained relative to bottom 12 of the package. Bar 272 can be any known hold-down bar including, but not limited to, a straight elongated bar (not shown), a curved bar or a hook (not shown). Depending on the type of bar utilized, the bar is secured relative to the bottom of the package. In the case of curved hold-down bar 272, the bar can be positioned between a base sheet 277 bottom 12 of package 250 wherein base sheet 32 has an opening 279 sized to receive bar 272. The weight of coil C prevents upward movement of the bar. However, hold-down bar 272 can also be fastened to walls 15 and/or bottom 12. Force member 274 is attached between hold-down bar 272 and top bar 276 such that member 274 produces a downward force in top bar 276. Member 274 can be any know force producing member including, but not limited to, an elastic band and/or a spring.

Core stabilizer 260 utilizes hold-down mechanism 270 to maintain an inner core 278 relative to bottom 12. In this respect, stabilizer 260 includes a bar 280 having first and second ends 282 and 284, respectively. End 282 includes a hook 286 and end 284 includes a hook 288 which are shaped to engage an inner core 278. More particularly, core 278 includes a first set of openings 300 and 302 and a diametrically opposite two openings 304 and 306. Openings 300 and 304 are elongated to allow hooks 286 and 288, respectively to pass there through. Openings 302 and 306 are spaced from openings 300 and 304, respectively, to create a cross member 310 and 312, respectively, which are engaged by hooks 286 and 288. Further, openings 304 and 306 allow ends 282 and 284 to at least partially pass there through, respectively, such that downward force by bar 280 is directed to cross members 310 and 312.

In operation, bar 280 can be placed through elastic band hold-down strap 274 such that bar 280 is shipped ready for operation. In another embodiment, bar 280 can be positioned after the hold-down mechanism has been released. If bar 280 is shipped with package 250, once the package is in position for use, top bar 276 can be released from its engagement with coil top CT and a top 320 of elastic band 274 such that band top 320 moves downwardly within the package until it engages bar 280. Once in engagement with bar 280, band 274 produces a downward force on core 278 to prevent the core from "walking-up" the inner surface of the wire coil. However, as can be appreciated, a separate downward force producing element could be used to urge bar 280 downwardly, and thus core 278, downwardly. By utilizing a separate element, an ideal downward force on the bar can be more easily achieved. As can also be appreciated, while this embodiment does not rigidly prevent later or transverse motion of the core, it prevents the core from "walking-up" the wire coil. Further, the downward force on the core also has a stabilizing effect on the core since it is not free to move within the wire coil.

As with the embodiments discussed above, sheet 277 can be configured to help prevent motion of stabilizer 260 relative to coil C in addition to the weight of the coil. In this respect, base 277 has outer edges 290-297 and is sized such that these edges engage the inner surfaces 16 of walls 15 and corner supports 18. Base 277 further includes upper surface 298 and lower surface 299 wherein coil bottom CB rests on surface 298 such that the weight of wire W is resting on base 277 and further prevents movement of the stabilizer relative to the coil.

The embodiments of this application, described above, can also include a retainer or braking ring (not shown) to help control the unwinding of the wire from the wire coil. The hold-down mechanism can utilize the retainer ring to produce an even downward force on coil top CT. As is known in the art, the packages can further include a ring protection member (not shown) which extends between top bar 276 and the retainer. Further, the embodiments can include a protrusion(s) that at least partially extend(s) outwardly of the respective core without detracting from the invention of this application.

As is stated above, while only a few package configurations are shown, the invention of this application can be used with a wide range of welding wire packages and package accessories known in the art. The accessories include, but are not limited to, package liners between the side wall(s) and outer surface walls 15, vapor barriers, different corner supports, hold-down mechanisms and a wide range of retainer rings.

While considerable emphasis has been placed on the preferred embodiments of the invention illustrated and described herein, it will be appreciated that other embodiments and/or equivalents thereof can be made and that many changes can be made in the preferred embodiments without departing from the principals of the invention. Accordingly, it is to be distinctly understood that the foregoing descriptive matter is to be interpreted merely as illustrative of the invention and not as a limitation.

Having thus defined the invention, the following is claimed:

1. A package for containing and dispensing wire from a coil of welding wire,
- the coil having
  - a coil axis parallel to a package axis,
  - a coil top transverse to the coil axis and an opposite coil bottom,
  - the wire coil further including radially inner and outer surfaces parallel to the coil axis, the inner surface defining an inner cylindrical opening coaxial with the coil axis having an opening diameter,
- said package comprising
  - an outer layer having a bottom and
  - at least one outer side wall having a upper edge defining a box opening for removing the wire from said package,
- said package further including
  - an inner core positioned within the inner cylindrical opening of the wire coil,
  - said inner core having a core base supported by said bottom and an oppositely facing core top,
  - said inner core further including an outer diameter coaxial with said coil axis when at rest and
  - said core outer diameter being less than said opening diameter such that said package further includes a gap between said inner core and said wire coil thereby allowing relative motion of said inner core relative to said coil,
- said package further including
  - a structure at least near said bottom of said package, said structure being fixed relative to said bottom and frictionally engaging an inner surface of said inner core such that said structure substantially prevents lateral movement of said core base during the unwinding of the wire while allowing said core top to be controllably tilted by the engagement of the wire alone as the wire exits said package while allowing said core to move vertically relative to said base.

2. The package according to claim 1, wherein said outer layer is a drum.

3. The package according to claim 1, wherein said outer layer is a square box wherein said at least one outer side wall is four side walls.

4. The package according to claim 3, further including
- an inner layer between the radially outer surface of the wire coil and said four side walls.

5. The package according to claim 4, further including
- corner supports between said inner layer and said outer layer.

6. The package according to claim 1, wherein said structure includes at least one upward extending protrusion fixed relative to said bottom, said structure extending above said coil bottom.

7. The package according to claim 1, wherein said structure includes at least one upward extending protrusion and a planar base sheet between said bottom of said outer layer and the coil bottom, said at least one upward extending protrusion extending from said base sheet.

8. The package according to claim 1, wherein said structure includes at least one upward extending protrusion fixed relative to said bottom.

9. The package according to claim 6, wherein said at least one upward protrusion is a plurality of protrusions spaced from said package axis to engage said inner surface of said core.

10. The package according to claim 8, further including a hold-down bar to prevent the coil from springing upwardly during the transportation of said package and a hold-down strap engageable with said hold-down bar to urge said bar downwardly, said at least one upward extending protrusion including a passage to allow said hold-down strap to extend through said core.

11. A package for containing and dispensing wire from a coil of welding wire, the coil having a coil axis parallel to a package axis, a coil top transverse to the coil axis and an opposite coil bottom, the wire coil further including radially inner and outer surfaces parallel to the coil axis, the inner surface defining an inner cylindrical opening coaxial with the coil axis, said package comprising an outer layer having a bottom and at least one outer side wall having a upper edge defining a box opening for removing the wire from said package, said package further including an inner core positioned within the inner cylindrical opening of the wire coil, said inner core having at least one side wall extending from a bottom edge to a top edge, said bottom edge forming a core base and said bottom being substantially open such that said bottom edge supports said core on said bottom, said package further including an upwardly extending structure fixed relative to said bottom, said structure frictionally engaging an inner surface of at least a portion of said at least one side wall of said core such that said core base is generally fixed laterally relatively to said bottom and is frictionally releasable vertically from said structure, said core top being controllably tiltable by the engagement by the wire alone as the wire exits said package.

12. A core retainer for a package for containing and dispensing wire from a coil of welding wire, the coil having a coil axis parallel to a package axis, a coil top transverse to the coil axis and an opposite coil bottom, the wire coil further including radially inner and outer surfaces parallel to the coil axis, the inner surface defining an inner cylindrical opening coaxial with the coil axis, the package having an outer layer with a bottom and at least one outer side wall having a upper edge defining a box opening for removing the wire from the package, an inner core positioned within the inner cylindrical opening of the wire coil and having a core base and an oppositely facing core top with a side wall extending between said core base and said core top, said core retainer comprising at least one upward extending protrusion fixed relative to said bottom shaped to frictionally engage an inner surface of said side wall of said core near said core base and generally maintain said core base relatively to the bottom of the package while allowing said core top to be tilted by the wire as the wire exits said package.

* * * * *